United States Patent [19]

Houston

[11] 4,014,302

[45] Mar. 29, 1977

[54] DEVICE TO REDUCE THE NITROGEN OXIDE CONTENT IN THE EXHAUST GAS OF AN INTERNAL COMBUSTION ENGINE

[75] Inventor: George F. Houston, Milwaukee, Wis.

[73] Assignee: Briggs & Stratton Corporation, Wauwatosa, Wis.

[22] Filed: Jan. 9, 1976

[21] Appl. No.: 648,119

Related U.S. Application Data

[63] Continuation of Ser. No. 558,205, March 14, 1975, abandoned, which is a continuation-in-part of Ser. No. 453,647, March 21, 1974, abandoned.

[52] U.S. Cl. ..... 123/119 A

[51] Int. Cl.[2] ..... F02M 25/06

[58] Field of Search ..... 123/119 A, 139 AS, 139 A

[56] References Cited

UNITED STATES PATENTS

| | | | |
|---|---|---|---|
| 3,648,672 | 3/1972 | Muruki et al. | 123/119 A |
| 3,844,261 | 10/1974 | Garcea | 123/119 A |
| 3,881,456 | 5/1975 | Nohira et al. | 123/119 A |
| 3,885,538 | 5/1975 | Suter | 123/119 A |

*Primary Examiner*—Wendell E. Burns
*Attorney, Agent, or Firm*—Ira Milton Jones & Associates

[57] ABSTRACT

A system for reducing the nitrogen oxide content of exhaust gas emitted by an internal combustion engine, by introducing exhaust gas from the engine into the fuel mixture being supplied to the engine. A valve that is adjusted by a pressure sensitive actuator responsive to changes in pressure in the engine crankcase proportions the amount of exhaust gas introduced into the fuel mixture to engine speed, and another valve that is controlled by adjustment of the throttle valve prevents introduction of the exhaust gas into the fuel mixture when the engine is idling and when it is operating at high speed and under high loads.

14 Claims, 8 Drawing Figures

DEVICE TO REDUCE THE NITROGEN OXIDE CONTENT IN THE EXHAUST GAS OF AN INTERNAL COMBUSTION ENGINE

This application is a continuation of now abandoned application Ser. No. 558,205, filed Mar. 14, 1975, which was a continuation-in-part of now abandoned Ser. No. 453,647, filed Mar. 21, 1974.

This invention is concerned with the problem of air pollution resulting from the presence of nitrogen oxide in the exhaust gas emitted by an internal combustion engine.

As in the U.S. Pat. No. 3,648,672 issued Mar. 14, 1972 to Toyo Kogyo Company Limited, the present invention attacks the nitrogen oxide problem by reducing the temperature in the combustion chamber, hereinafter called combustion temperature, through the introduction into the fuel mixture supplied to the engine of part of the exhaust gas from the engine; and like the system of the aforesaid patent, coordinates the admission of the exhaust gas into the fuel mixture with the different operating conditions of the engine. However, in contrast with the system disclosed in the aforesaid patent, the present invention achieves its purpose in a much simpler way, by controlling the amount of exhaust gas that is returned to the engine in accordance with changes in engine speed as manifested by the pulsating negative pressure within the crankcase of the engine, and by making the return of the exhaust gas dependent upon the position of the throttle valve of the engine.

More specifically, this invention has as its purpose and object to control the proportion of exhaust gas that is introduced into the engine by a proportioning valve that is moved between open and closed positions by a pressure sensitive actuator responsive to pressure differential between the crankcase interior and atmosphere, so that as long as the pressure sensitive actuator is connected with the crankcase interior, the amount of the exhaust gas returned to the engine is proportional to engine speed.

Another object of this invention is to control communication between the crankcase interior and the pressure sensitive actuator for the proportioning valve by a valve connected in the suction line leading to the actuator and operatively connected with the shaft of the throttle valve to be open only when the engine is not idling and when it is not operating at high speed under high load. At idling speed, the combustion temperature is not high enough to produce an objectionably large percentage of nitrogen oxide in the exhaust so that the addition of inert gas to the fuel mixture at that time accomplishes no useful purpose, and when the engine is operating at high speed and under high load conditions calling for maximum power output, dilution of the fuel mixture in any manner must be avoided.

In summation, it is the purpose and object of this invention to provide a greatly simplified imminently practicable system for effecting controlled recycling of exhaust gas emitted by an internal combustion engine with a view to lowering the combustion temperature and thereby reducing the nitrogen oxide content of the exhaust gas discharged into the atmosphere.

With these observations and objectives in mind, the manner in which the invention achieves its purpose will be appreciated from the following description and the accompanying drawings, which exemplify the invention, it being understood that changes may be made in the precise method of practicing the invention and in the specific apparatus disclosed herein without departing from the essentials of the invention set forth in the appended claims.

The accompanying drawings illustrate two complete examples of the physical embodiment of the invention constructed according to the best modes so far devised for the practical application of the principles thereof, and in which.

Figure 1:
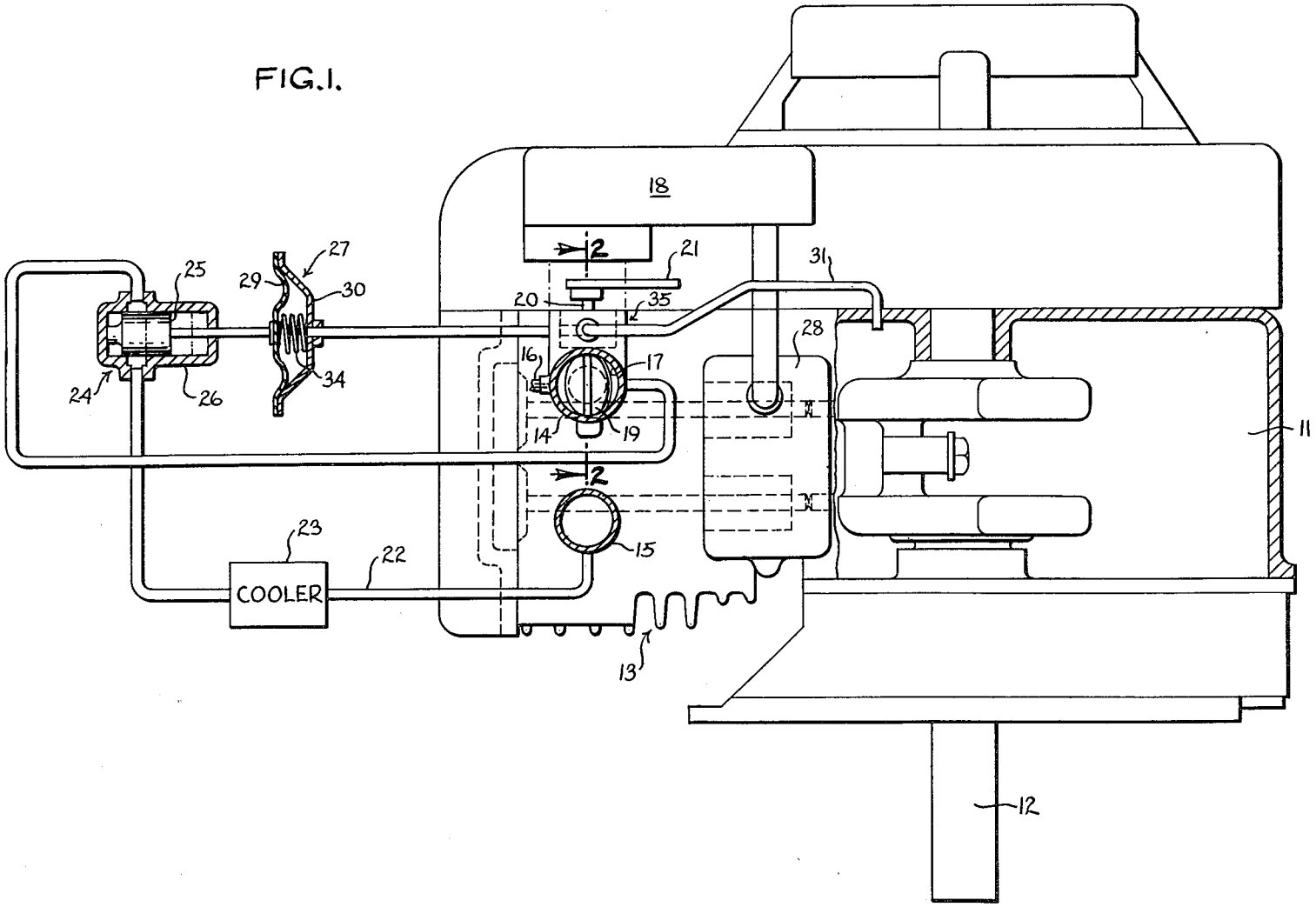
FIG. 1 is a more or less schematic view illustrating the adaptation of the invention to a single cylinder internal combustion engine.

Referring to the drawings, the numeral 10 designates generally a conventional single cylinder four stroke cycle internal combustion engine. As is customary, the engine 10 has a crankcase 11 in which is mounted the crankshaft 12 with its power takeoff end projecting downward since the illustrated engine is of the vertical shaft variety. The engine cylinder 13 projects laterally from the crankcase and has the usual intake and exhaust ports, the former having a carburetor 14 connected thereto and the latter having an exhaust duct 15 leading therefrom to a muffler, not shown.

Figure 4:
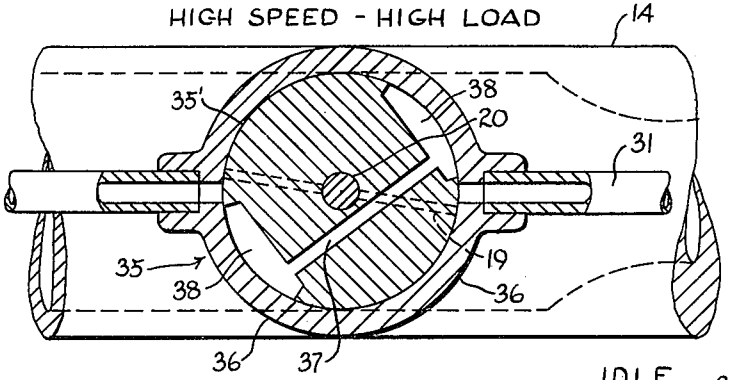
FIGS. 4, 5 and 6 are horizontal sectional views through FIG. 2 on the plane of the line 6—6, and respectively illustrating the suction line leading to the pressure sensitive actuator for the proportioning valve closed during the "high speed-high load" and the "idling" speed settings of the throttle valve; and "open" during all other positions of the throttle valve.

The carburetor 14 is of course provided with a fuel admission inlet diagrammatically indicated at 16, through which fuel is drawn into the mixture passage 17 of the carburetor for admixture with air coming from an air cleaner 18. The carburetor also has a throttle valve 19 mounted on a shaft 20 for adjustment between a wide open "high speed-high load" position shown in FIG. 4, and an idling position shown in FIG. 5.

A lever 21 fixed to the throttle shaft enables the valve to be adjusted to cause the engine to run at a selected speed. While the lever 21 can be directly moved to effect the desired adjustment, it is preferable to effect that adjustment through a governor mechanism (not shown) and which may be like that of the Brown U.S. Pat. No. 2,908,263. The governor automatically adjusts the throttle valve as needed to maintain the selected engine speed despite variations in load.

Since the objective of this invention is to reduce the nitrogen oxide content of the exhaust gases emitted by the engine by reducing the temperature of the combustion chamber with the introduction of inert gas in the form of a fraction of the exhaust gas, the exhaust duct 15 is connected with the mixture passage 17 of the carburetor by a tube 22. A gas cooler 23 of any suitable type may be connected in series with the tube 22. A flow control valve 24 also in series with the tube 22 governs flow of the exhaust gas to the carburetor. This valve need not be of any particular type as long as it is capable of completely blocking and also metering flow therethrough.

To meet its requirements, the valve has an adjustable closure member, illustrated in FIG. 1 as a piston 25 slidable in a cylinder 26 between a closed position blocking communication between the inlet and outlet ports of the valve and an open position (indicated in dotted lines in FIG. 1) permitting maximum flow through the valve. Obviously, of course, by movement of the piston between its closed and open positions, the flow through the valve is metered.

The amount of exhaust gas reaching the carburetor is proportioned to the operating condition of the engine by connecting the piston 25 to the movable element of a pressure sensitive actuator 27. This actuator is responsive to changes in the differential between the ambient atmosphere and the pulsating negative pressure maintained in the interior of the engine crankcase during operation of the engine by virtue of the customary crankcase breather 28 with which the engine is equipped, and which is preferably like that of the Lechtenberg U.S. Pat. No. 2,693,791. Since the magnitude of the negative pressure is a function of engine speed, it follows that the pressure sensitive actuator 27 — due to its connection with the crankcase interior — will move the piston 25 in the direction to increase the flow of exhaust gas to the carburetor as engine speed rises, and vice versa. In this connection, it should be understood that because the engine is of the single cylinder variety — or at least one in which a pulsating negative pressure exists at all times — the magnitude of that negative pressure is a direct reflection of the speed of the engine.

Figure 7:
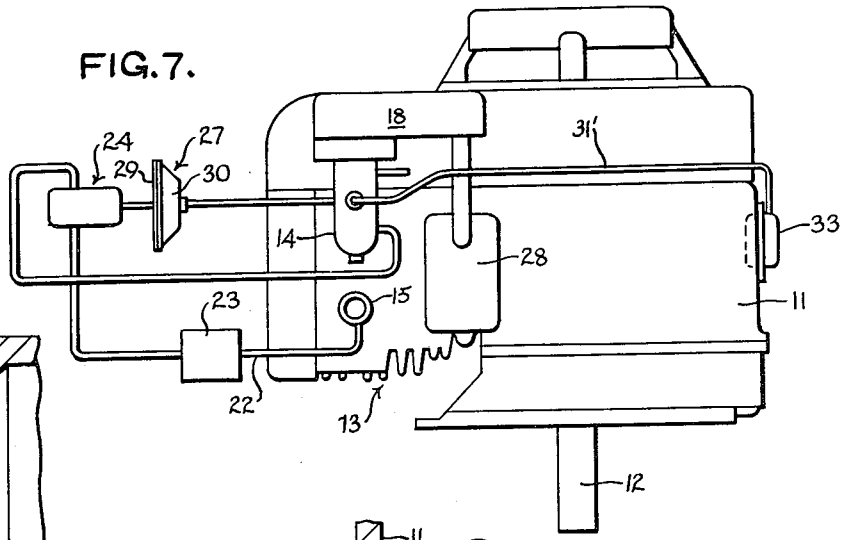
FIG. 7 is a view similar to FIG. 1, but at a reduced scale, illustrating a modified embodiment of the invention.
Figure 8:
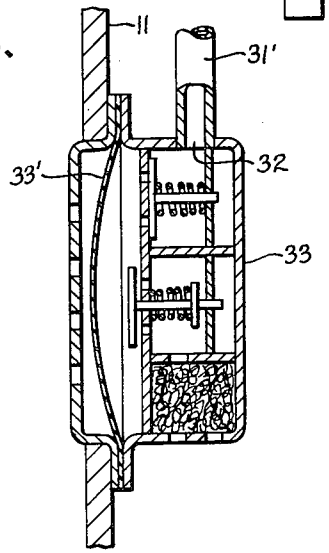
FIG. 8 is a sectional view through an air pump used in the modified embodiment of the invention to operate the pressure sensitive actuator for the proportioning valve.
Figure 2:
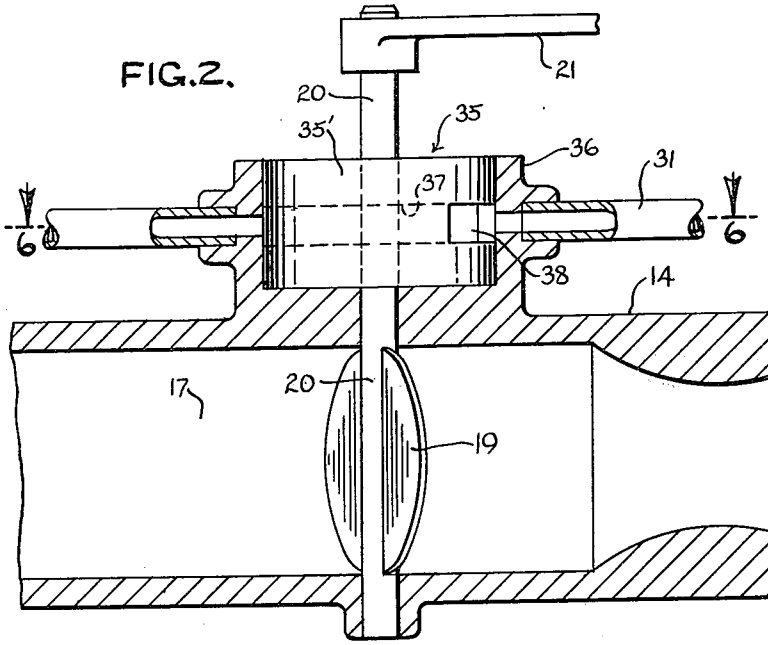
FIG. 2 is an enlarged fragmentary sectional view through FIG. 1 on the plane of the line 2—2.
Figure 3:
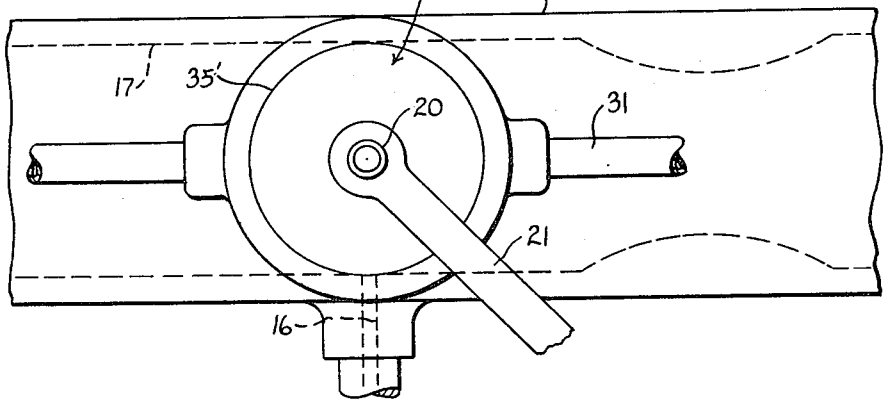
FIG. 3 is a top view of the structure shown in FIG. 2.

Although the pressure sensitive actuator 27 may be of any suitable type, for purposes of illustration it has been shown as of the diaphragm variety in which a flexible diaphragm 29 across the mouth of a cup-shaped shell 30 responds to changes in pressure differential at opposite sides of the diaphragm. To produce that pressure differential in a way that reflects the operating condition of the engine, the interior of the shell is connected with the crankcase interior through a duct 31 in the FIG. 1 embodiment of the invention, and through a duct 31′ with the discharge port 32 of a pump 33 in the modified embodiment of the invention shown in FIG. 7.

In either case, the pressure differential inside and outside the crankcase provides a power source that rises and falls with changes in engine speed, and hence is indicative of the operating condition of the engine. By using that force to shift the movable element (piston 25) of the flow control valve, the volume of exhaust gas delivered to the carburetor is governed by the operating conditions of the engine. This is so whether it is the suction resulting from the negative crankcase pressure that is employed to actuate the movable member of the flow control valve, or the positive pressure delivered by the pump 33, since the pump is of the type in which a diaphragm 33′ responsive to pressure pulsations in the crankcase provides the pumping force.

When the pressure sensitive actuator 27 is connected with the crankcase interior as in FIG. 1, a spring 34 yieldingly urges its diaphragm 29 outwardly (to the left in FIG. 1) to move the piston 25 of the flow control valve toward its closed position, from which it is drawn by response of the diaphragm to suction manifested in the shell 30. If the pressure sensitive actuator 27 is connected to respond to the positive pressure delivered by the pump 33, the spring must urge the movable member of the flow control valve to the right (in FIG. 1).

As explained hereinbefore, when the engine is called upon to deliver maximum power, at which time the throttle valve is in its wide open position, there should be no dilution of the fuel mixture. Hence under those conditions the pressure sensitive actuator 26 should be disconnected from the source of its actuating power, i.e. the suction in the crankcase in FIG. 1 and the positive pressure delivered by the pump 33 in FIG. 7. As also explained, when the engine is idling there is no point in bringing exhaust gas to the carburetor, so that during that condition too, the pressure sensitive actuator should be disconnected from its power source. But during all other operating conditions, which can be regarded as the normal operating range, the dilution of the fuel mixture by the addition of exhaust gas thereto can be tolerated and has the beneficial effect of reducing the nitrogen oxide content in the exhaust emitted by the engine in consequence of the cooling effect upon combustion temperature which results from dilution of the fuel mixture. Connection of the pressure sensitive actuator with its power source is therefore made dependent upon throttle valve position.

For that purpose, a control valve 35 connected in series in the line 31, 31′ is actuated by the throttle shaft 20 to be open only when the throttle is within the normal operating range of adjustment. The specific design of this control valve is a matter of choice but as illustrated in the drawings, it can consist of a disc 35′ fixed to the throttle valve shaft 20 and rotatable in a cylindrical valve housing 36 to control communication between the inlet and outlet ports of the control valve.

As long as the throttle valve occupies a position within the normal operating range the inlet and outlet ports of the control valve are communicated with one another through a passage 37 that extends through the rotary valve disc and has circumferentially extending mouths 38 which maintain communication with the inlet and outlet ports throughout a relatively wide range of throttle valve adjustment. Adjustment of the throttle valve beyond either end of that range carries the mouths of the through passage 37 out of communication with the inlet and outlet ports.

Figure 6:
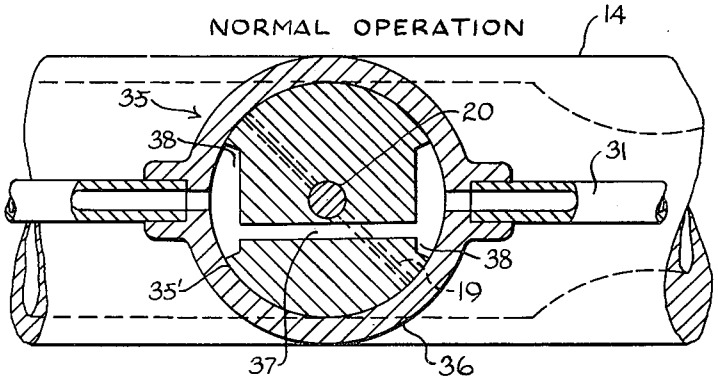

FIG. 6 illustrates the throttle valve at substantially the midpoint of its normal operating range of adjustment with the inlet and outlet ports of the control valve communicated. That communication will be maintained throughout the normal operating range of throttle valve adjustment, but when the throttle valve is in its fully open position as in FIG. 4, the rotary valve disc occupies a position blocking communication between the inlet and outlet ports of the control valve.

Figure 5:
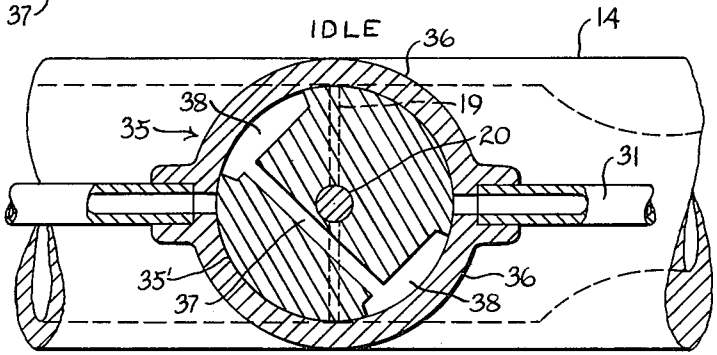

As shown in FIG. 5, flow through the control valve is also blocked when the throttle valve is in its substantially closed idling position; but in this case it is not because dilution of the fuel mixture would adversely affect engine operation that the control valve disconnects the pressure sensitive actuator from its source of motive power, but because during idling the combustion temperature does not reach the point at which nitrogen oxide production is a serious factor. So, during idling, there is no point in adding inert gas to the fuel mixture.

Because of the nature of the governor systems of engines of the types here involved, the frictional resistance to adjustment of the throttle valve should be held to its barest minimum. Hence the disc 35' of the control valve 35 must rotate very freely in its housing 36, and to assure that freedom there must be running clearance between the contiguous surfaces of the rotatable disc and the housing. That required clearance obviates the need for a vent to bleed the line 31, 31' between the control valve 35 and the pressure sensitive actuator 27, as would be the case if valve 35 were tightly sealed. Accordingly, this running clearance makes it possible for the springs 34 acting in conjunction with the force resulting from the varying pressure pulsations in the crankcase to continually adjust the flow control valve 24 to the speed of the engine. It is, of course, understood that pressure losses due to leakage through the running clearance of the valve 35 are not sufficient by comparison with the air pressure — negative or positive — acting on the diaphragm of the valve 27, to seriously interfere with its response to fluctuations in crankcase pressure.

Those skilled in the art will appreciate that the invention can be embodied in forms other than as herein disclosed for purposes of illustration.

The invention is defined by the following claims:

I claim:

1. In combination with an internal combustion engine having a fuel mixture inlet, an exhaust gas outlet and a crankcase in which, when the engine is running, a pulsating negative pressure exists that varies in magnitude with changes in engine speed, said pulsating negative pressure providing a power source of correspondingly varying magnitude, means for reducing the nitrogen oxide content of the exhaust gas emitted by the engine, comprising:

A. duct means through which said fuel mixture inlet is communicable with said exhaust gas outlet;

B. adjustable flow metering means associated with said duct means to regulate communication of said fuel mixture inlet means with said exhaust gas outlet; and C. power translating means operatively connected with said power source to be responsive thereto and with said adjustable flow metering means to adjust the latter in accordance with the response of said power translating means to changes in the magnitude of said power source and thereby coordinate the admission of exhaust gas to said fuel mixture inlet with changes in the operating condition of the engine.

2. The invention defined by claim 1, further characterized by:

A. biasing means acting on said adjustable flow metering means in a manner to restrict communication between said fuel mixture inlet and said exhaust gas outlet; and B. wherein said power translating means opposes the bias on said adjustable flow metering means so that the amount of exhaust gas permitted to enter said fuel mixture inlet increases with a rise in the magnitude of said power source.

3. The invention of claim 2, further characterized by:

A. adjustable engine speed governing means operatively connected with the engine; and B. connection-disrupting means operatively connected with said engine speed governing means and with the connection of said power translating means with the power source, to disrupt said connection when said adjustable engine speed governing means is adjusted to effect operation of the engine at a speed outside a predetermined range.

4. The invention of claim 3, wherein said connection disrupting means includes means for disrupting said connection when said adjustable speed adjusting means is set to effect either idling of the engine or operation thereof at maximum speed and power.

5. The invention of claim 1, wherein said power source is a source of pulsating gas pressure, wherein said flow metering means includes a valve element movable between open and closed positions, wherein said power translating means comprises 1. a pressure sensitive actuator having a motion transmitting connection with said valve element, and 2. biasing means acting on said pressure sensitive actuator and urging it in the direction to effect movement of said valve element towards its closed position, wherein the connection of the power translating means with the power source comprises gas flow conducting means communicating said pressure sensitive actuator with said source of pulsating gas pressure, so that said pulsating gas pressure opposes said biasing means and thereby determines the position of said pressure sensitive actuator and said valve element connected therewith.

6. The invention of claim 5, further characterized by:

A. adjustable engine speed governing means operatively connected with the engine; and B. flow controlling means operatively connected with said adjustable engine speed governing means and with said gas flow conducting means to prevent flow therethrough except when the engine speed is within a preselected range.

7. The invention of claim 6, wherein said adjustable engine speed governing means is the throttle valve of the engine, and wherein said flow controlling means is a valve in series with said flow conducting means, said valve having inlet and outlet ports and a rotatable plug connected with the throttle valve to control communication between said ports in accordance with changes in the position of the throttle valve.

8. The invention of claim 1, wherein said adjustable flow metering means is a valve in said duct means, and wherein said power translating means comprises 1. a pressure sensitive actuator connected with said valve, and 2. gas flow conducting means connecting said pressure sensitive actuator with the power source.

9. The invention of claim 8, further characterized by:

A. an adjustable throttle valve to control admission of the fuel mixture to said fuel mixture inlet for governing engine speed and power; and B. a second valve in said gas flow conducting means and operatively connected with said throttle valve to coordinate the functioning of said pressure sensitive actuator with the position of the throttle valve.

10. Means for reducing the nitrogen oxide content of the exhaust gas from an internal combustion engine of the type having intake and exhaust ports and a crankcase in which, when the engine is running, a pulsating negative gas pressure exists that varies with changes in engine speed, comprising:

A. duct means connected between said intake and exhaust ports through which exhaust gas can reach the intake port of the engine;

B. first control valve means responsive to pressure differential between the interior of the engine crankcase and atmosphere, and operatively connected with said duct means to control flow therethrough in accordance with changes in said pressure differential;

C. a throttle valve operative to selectively control the speed and power output of the engine; and D. second control valve means operatively connected with said first control valve means and connected with the throttle valve to govern the functioning of said first control valve means to make communication between said intake and exhaust ports dependent upon throttle valve position.

11. In combination with an internal combustion engine of the type having intake and exhaust ports and a crankcase in which, when the engine is running, a pulsating negative gas pressure exists that varies with changes in engine speed:

A. first duct means selectively connectable between said intake and exhaust ports for selectively introducing a portion of the exhaust gas into the intake port;

B. first control valve means operatively connected in said first duct means to control communication between said intake and exhaust ports;

C. pressure sensitive actuating means for said first control valve means;

D. second duct means to transmit signals of changes in pressure differential between the interior of the engine crankcase and atmosphere to said pressure sensitive actuating means to effect opening of said first control valve means to communicate said intake and exhaust ports;

E. a throttle valve operative to selectively control the speed and power output of the engine; and F. second control valve means operatively connected with said throttle valve and operative in response to adjustment of said throttle valve, to govern responsiveness of said pressure sensitive actuating means to said signals and thereby make communication between said intake and exhaust ports dependent upon throttle valve position.

12. Means for reducing the nitrogen oxide content of the exhaust gas emitted by an internal combustion engine of the type having a fuel mixture inlet, an exhaust gas outlet, and a crankcase in which, when the engine is running, a pulsating negative gas pressure exists that varies with engine speed, said means comprising:

A. duct means connecting the fuel mixture inlet with the exhaust gas outlet and through which part of the exhaust gas issuing from the engine can be introduced into the fuel mixture inlet;

B. a control valve in said duct means to control flow therethrough;

C. fluid pressure responsive motion producing means connected with said valve to adjust the position thereof;

D. means operatively connected with said fluid pressure responsive motion producing means to render it responsive to changes in pressure differential between the interior of the engine crankcase and atmosphere, whereby an increase in the magnitude of the pressure differential effects opening adjustment of said control valve and a decrease in the magnitude thereof effects closing adjustment of said valve;

E. an adjustable throttle valve for controlling the admission of the fuel mixture to the engine, said throttle valve being near one limit of its range of adjustment when the engine is delivering full power and near the other limit of its range of adjustment when the engine is idling; and F. control means operatively connected with the throttle valve and with said fluid pressure responsive motion producing means to govern responsiveness of the latter to changes in said pressure differential and render it incapable of opening said control valve when said throttle valve occupies a position near one or the other of its limits of adjustment.

13. Means for reducing the nitrogen oxide content of the exhaust gas from an internal combustion engine of the type having intake and exhaust ports and a crankcase in which, when the engine is running, a pulsating negative gas pressure exists, comprising:

A. duct means connected between said intake and exhaust ports through which exhaust gas can reach the intake port;

B. cooling means to cool the exhaust gas entering said intake port;

C. first control valve means responsive to pressure differential between the interior of the engine crankcase and atmosphere, and operatively connected with said duct means to flow therethrough;

D. a throttle valve operative to selectively control the speed and power output of the engine; and E. second control valve means operatively connected with said first control valve means and connected with the throttle valve to govern the functioning of said first control valve means and make communication between said intake and exhaust ports dependent upon throttle valve position.

14. The invention defined by claim 13, wherein said second control valve means comprises:

A. a valve disc connected with the throttle valve to rotate about a fixed axis as the throttle valve is adjusted; and B. a cylindrical valve housing in which the valve disc turns, said valve housing having inlet and outlet ports, and said valve disc having a through passage for communicating said inlet and outlet ports, and the mouths at the ends of said through passage being circumferentially enlarged to maintain communication with the inlet and outlet ports through a predetermined range of rotation of the valve disc.

* * * * *